US009186897B2

(12) United States Patent
Yamamoto et al.

(10) Patent No.: US 9,186,897 B2
(45) Date of Patent: Nov. 17, 2015

(54) RECORDING HEAD

(75) Inventors: Akira Yamamoto, Yokohama (JP); Shuzo Iwanaga, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 326 days.

(21) Appl. No.: 13/095,813

(22) Filed: Apr. 27, 2011

(65) Prior Publication Data

US 2011/0273497 A1 Nov. 10, 2011

(30) Foreign Application Priority Data

May 10, 2010 (JP) ..... 2010-108406

(51) Int. Cl.
*B41J 2/14* (2006.01)
*B41J 2/155* (2006.01)

(52) U.S. Cl.
CPC ..... *B41J 2/155* (2013.01); *B41J 2/14072* (2013.01); *B41J 2202/20* (2013.01)

(58) Field of Classification Search
USPC ..... 347/5, 9, 19, 50, 20, 22, 1, 42
See application file for complete search history.

(56) References Cited

U.S. PATENT DOCUMENTS 5,345,256 A * 9/1994 Stortz ..... 347/20
6,076,914 A * 6/2000 Imai ..... 347/19
6,290,333 B1 * 9/2001 Wade et al. ..... 347/50
2004/0160465 A1 * 8/2004 Baker-Smith et al. ..... 347/1
2008/0273053 A1 * 11/2008 Takeuchi et al. ..... 347/22

FOREIGN PATENT DOCUMENTS

| | | | |
|---|---|---|---|
| JP | 02-206579 | A | 8/1990 |
| JP | 10-006534 | A | 1/1998 |
| JP | 2002-019146 | A | 1/2002 |
| JP | 2002-019146 | A | 1/2002 |
| JP | 2006-181985 | A | 7/2006 |
| JP | 2008-279616 | A | 11/2008 |
| JP | 2008-290387 | A | 12/2008 |
| KR | 10-1988-0006622 | A | 7/1988 |

* cited by examiner

*Primary Examiner* — Lam Nguyen
(74) *Attorney, Agent, or Firm* — Canon USA, Inc. IP Division

(57) ABSTRACT

A recording head includes: a recording element substrate having a recording element and a logic circuit cofigured to control driving of the recording element; and an electric wiring member cofigured to provide a wiring layer that has a first group of a plurality of terminals, a second group of a plurality of terminals, and a plurality of signal lines configured to connect the first group of terminals to the second group of terminals; wherein the plurality of signal lines includes a plurality of logic signal lines including a logic power source line, a logic ground line, and at least first and second logic signal lines, and wherein, on the wiring layer, a line pattern connected to one of the logic power source line and the logic ground line is disposed along the first and second logic signal lines.

7 Claims, 16 Drawing Sheets

RECORDING HEAD

BACKGROUND OF THE INVENTION

1. Field of the Invention

The present invention relates to a recording head discharging liquid such as ink.

2. Description of the Related Art

Inkjet recording apparatuses use nonimpact recording schemes, and have characteristics that they can record data in various recording media and at high speed, and make little noise during the recording. Thus, such inkjet recording apparatuses have been widely used as recording mechanisms as printer, word processor, facsimile, and copying machine.

Such inkjet recording apparatuses use ink discharge methods, including a representative one that uses heaters as recording elements. The representative method uses an inkjet recording head (hereinafter, also referred to as recording head) that has a recording liquid chamber provided with heaters and electrical pulses are applied to the heaters as recording signals. The heaters then generate discharge energy (thermal energy), which is given to a recording liquid to cause phase change thereof. At the time of phase change, the recording liquid bubbles (boils), so that the pressure of generated bubbles is used to discharge droplets of the recording liquid.

Japanese Patent Application Laid-Open No. 2002-19146 discusses an example of such recording head. FIG. 16 is a perspective diagram illustrating the recording head.

A recording head 1 in FIG. 16 has recording element substrates 2 and 3, each having a number of recording elements arranged thereon. The recording elements are each provided with discharge ports to discharge ink. Logic signals and a power source voltage are supplied to the recording element substrates 2 and 3 from an inkjet recording apparatus main unit (hereinafter, also referred to as recording apparatus main unit) through an electrical contact substrate 5 and an electric wiring member 4. As a result, driving circuits (logic circuits and voltage conversion circuits) in the recording element substrates 2 and 3 operate to drive predetermined recording elements for a predetermined period of time, hence ink is discharged from the discharge ports corresponding to the recording elements.

The logic signals each include "clock" as reference of logic circuit operation, "recording data" to determine recording elements to be driven, "latch signal" to temporarily store the recording data at a latch circuit that is one element of the logic circuit, and "heat enable signal" to determine a period of time to drive the recording elements.

In recent years, to further increase printing speed, a full wiring type recording head has been discussed, in which a large number of recording element substrates are arranged in zigzag and has a print width larger than that of a recording medium. In the recording head in FIG. 16, printing involves scanning of a recording medium by a recording head. In contrast, a full-wiring type recording head enables printing at high speed through single passing of a recording head, without scanning by the recording head, resulting in wide spread use of this type in recording apparatuses for business and industry.

Such full-wiring type recording head requires a large number of recording element substrates and also a large number of discharge ports to enable printing through one pass of the head without deterioration in image quality due to non-discharge of ink. Accordingly, formation of a large number of logic signal terminals is required to input/output logic signals, and a large number of logic signal lines are routed over an electric wiring member to transfer logic signals. Such structure may cause noise in the logic signal wiring.

For example, parallel logic signal lines may affect each other, causing capacitive coupling that induces noise. In general, longer and closer wiring causes capacitive coupling, and hence, in large-size recording heads such as those of full wiring type, noise is more likely to be induced.

In addition, a logic signal wiring located close to a power supply wiring where a large amount of current flows may be affected by induced noise. In a full wiring type recording head having a large number of discharge ports, as compared with recording head of smaller type, a larger number of recording elements are driven simultaneously, and a larger amount of current flows through power supply wiring that drives the recording elements, leading to induction of noise.

A logic signal affected by noise may lead to malfunction of logic circuits operated by the logic signals, and thereby recording elements may be driven at unexpected positions and timings, resulting in undesired discharge of ink and poor printing quality. In addition, highly responsive circuits for high frequency logic signals can react to noise, and thereby it is necessary to keep the high frequency logic signals from being affected by the noise.

To reduce influence of noise, high frequency logic signal wiring is required to be arranged not adjacent to the other high frequency logic signal wiring and power source wiring where a large amount of current flows. As described above, however, in a full wiring type recording head having a large number of logic signal wiring, not all of the high frequency logic signal wiring can be arranged as desired. Consequently, to reduce influence of noise, the spaces between the high frequency logic signal lines need to be increased, which eventually enlarges the electric wiring member, and eventually the recording head.

SUMMARY OF THE INVENTION

The present invention provides a recording head that overcomes the above problems. The recording head includes: a recording element substrate having a recording element and a logic circuit cofigured to control driving of the recording element; and an electric wiring member cofigured to provide a wiring layer that has a first group of a plurality of terminals, a second group of a plurality of terminals, and a plurality of signal lines configured to connect the first group of terminals to the second group of terminals; wherein the plurality of signal lines includes a plurality of logic signal lines including a logic power source line, a logic ground line, and at least first and second logic signal lines, and wherein, on the wiring layer, a line pattern connected to one of the logic power source line and the logic ground line is disposed along the first and second logic signal lines.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An inkjet recording head of the present invention is described with reference to the drawings.

Figure 1:
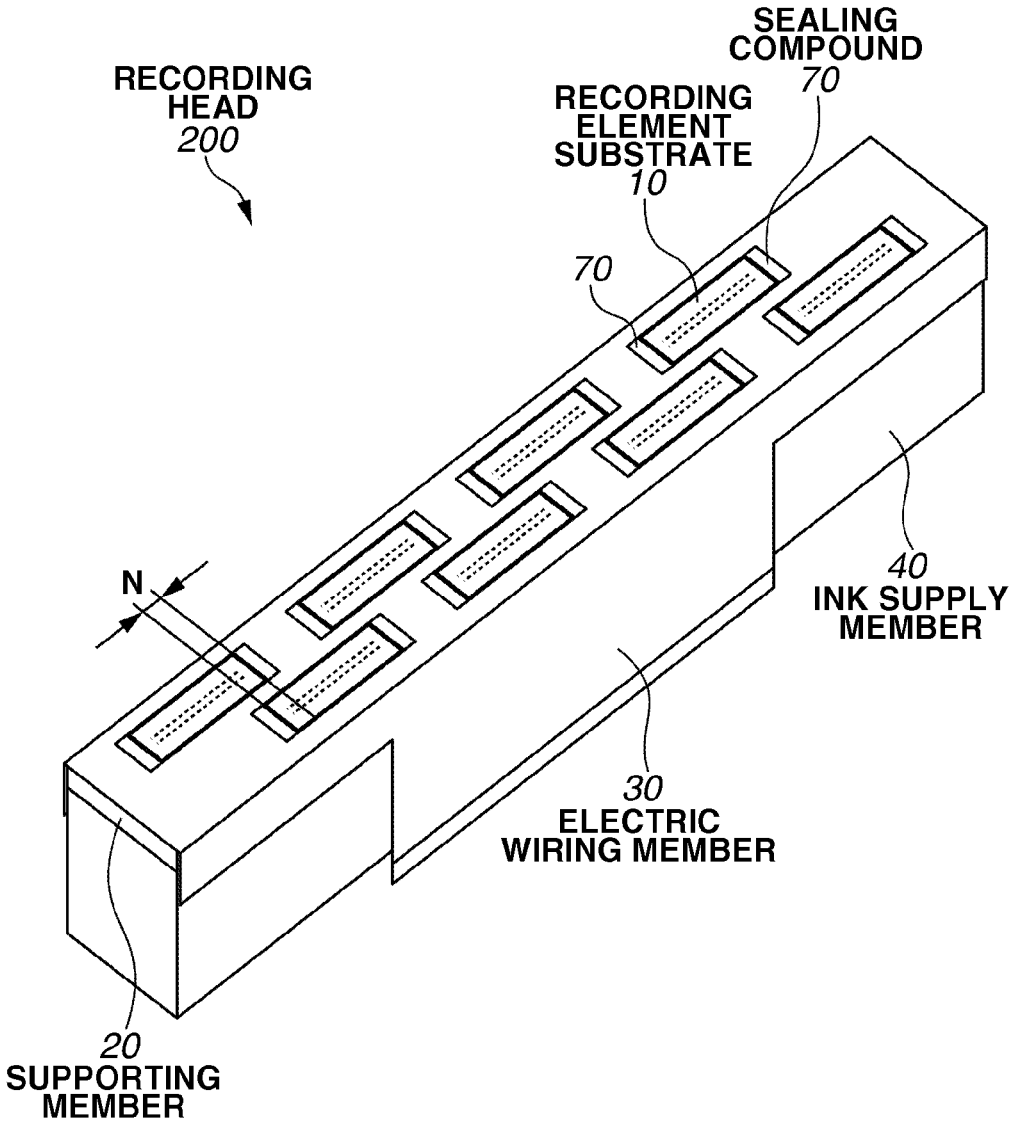
FIG. 1 is a schematic perspective diagram illustrating an inkjet recording head of the present invention.
Figure 2:
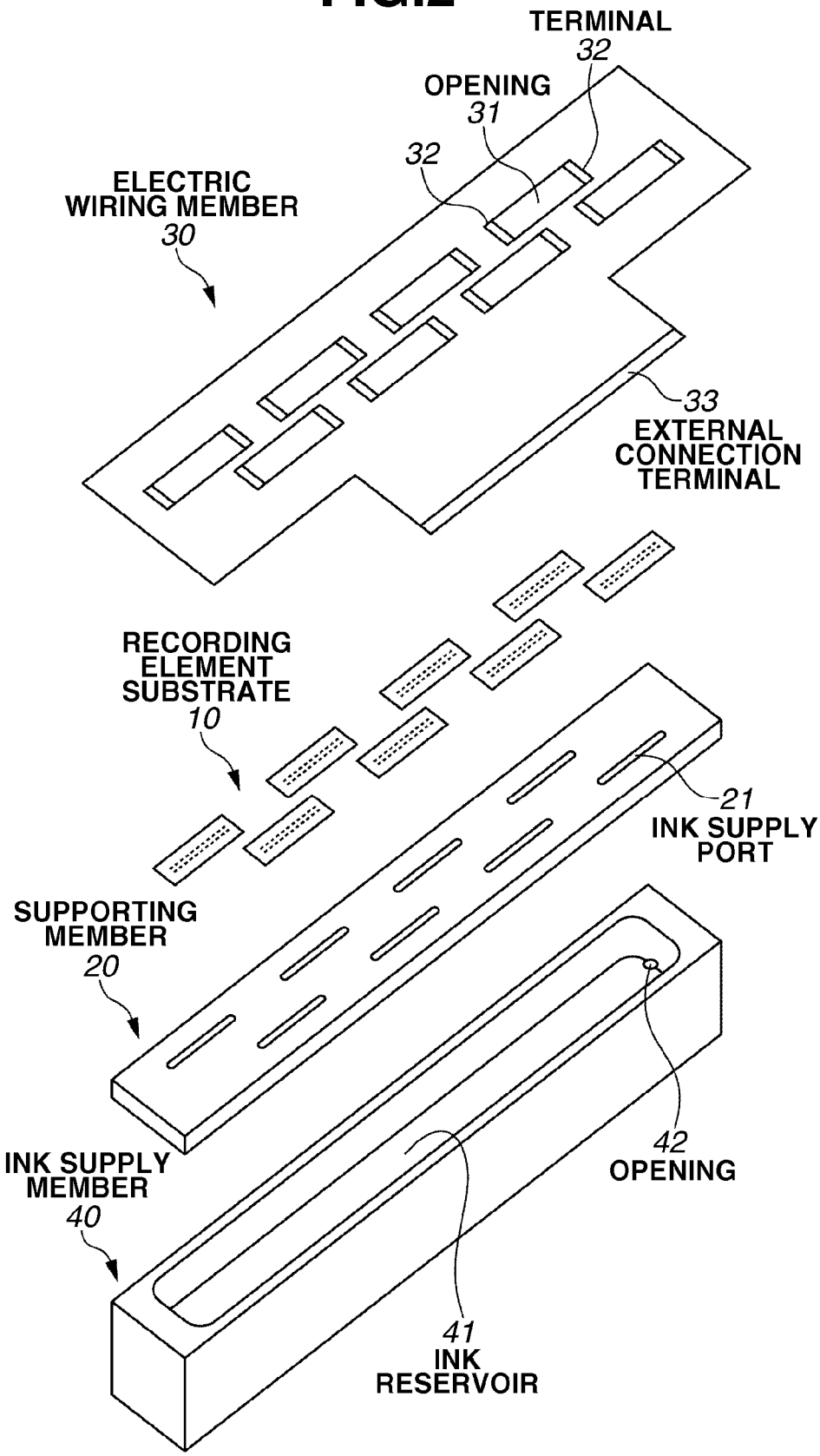
FIG. 2 is a schematic exploded perspective diagram illustrating the inkjet recording head in FIG. 1.
Figure 3A:
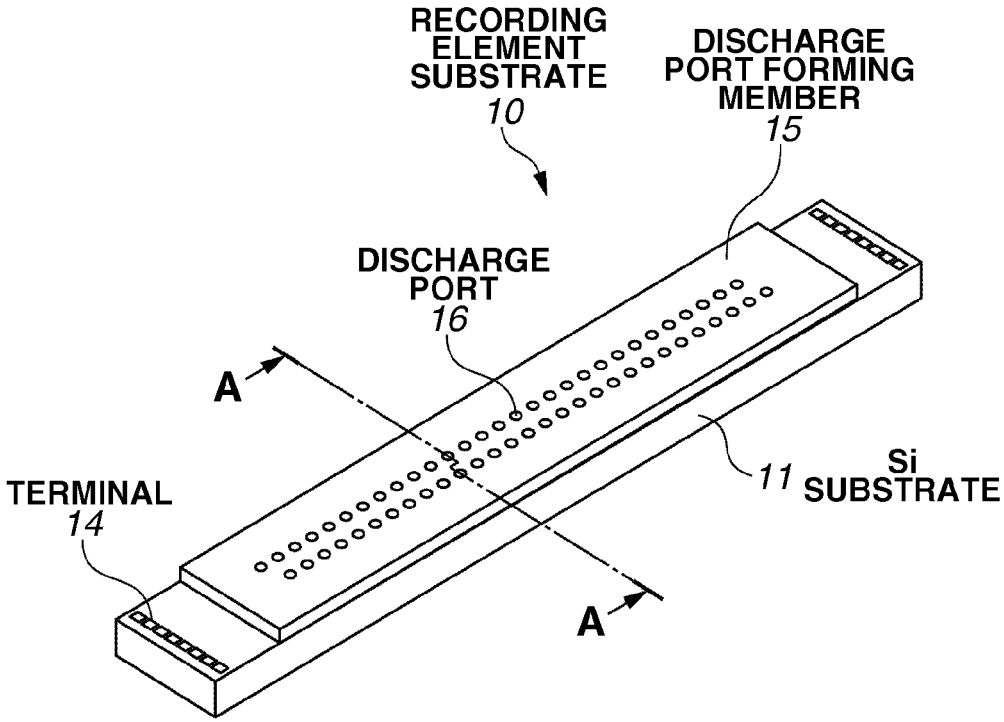
FIGS. 3A and 3B each schematically illustrate a structure of a recording element substrate in FIGS. 1 and 2.
Figure 3B:
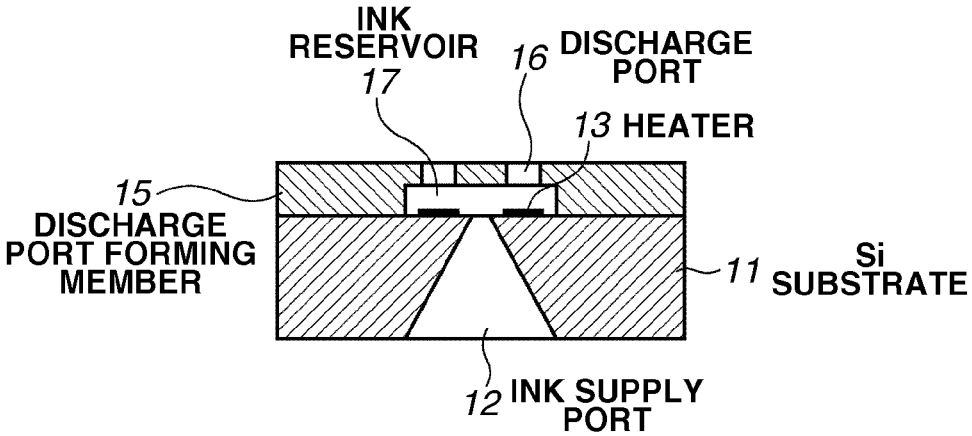
Figure 4:
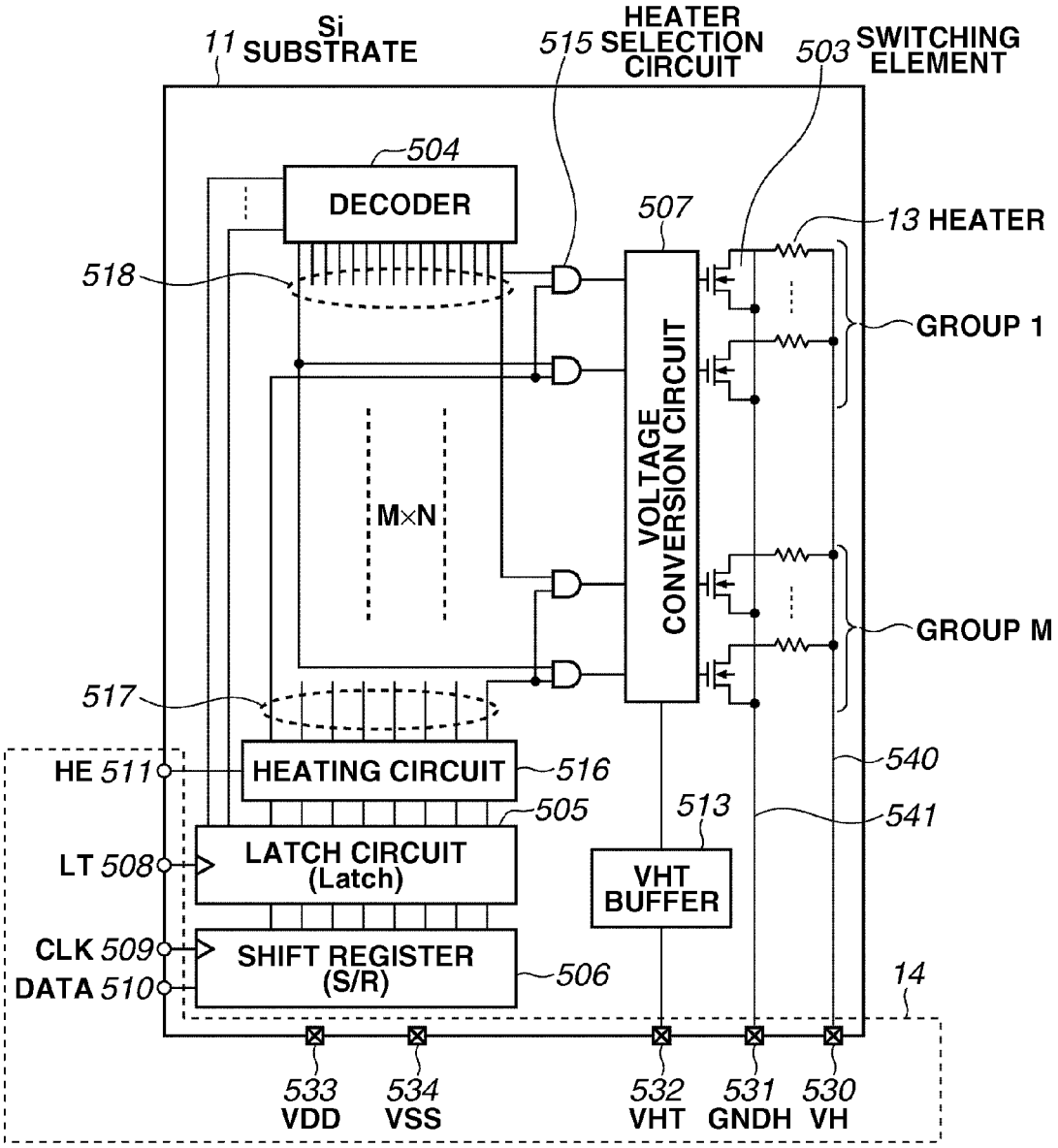
FIG. 4 schematically illustrates a circuit configuration on a recording element substrate of the recording head in FIGS. 1 and 2.

FIG. 1 is a perspective diagram illustrating a recording head. FIG. 2 is an exploded perspective diagram of the recording head in FIG. 1. FIG. 3 is a schematic diagram illustrating a structure of a recording element substrate 10 in FIGS. 1 and 2. FIG. 4 is a schematic diagram illustrating a circuit configuration on a recording element substrate 10 in FIGS. 1 and 2.

Referring to FIGS. 1 and 2, a recording head 200 includes recording element substrates 10, a supporting member 20, an electric wiring member 30, and an ink supply member 40.

The recording head 200 includes eight recording element substrates 10 arranged in zigzag and having a total print width of about 6 inches. Each of the eight recording element substrates 10 is arranged to have an overlapping area N with an adjacent recording element substrate 10 in the lateral direction, to correct deterioration in image quality caused by positional deviation of the recording element substrates 10. The recording head 200 can have a larger print width by increasing the number of the recording element substrates 10.

The recording element substrates 10 each are a device to discharge ink, and as illustrated in FIG. 3, composed of a Si substrate 11 having a thickness of 0.05 to 0.625 mm and having an ink supply port 12 that is precisely formed therein in the form of a long groove by wet or dry etching.

The Si substrate 11 has a plurality of heaters 13 as recording elements located across the ink supply port 12, and a driving circuit for driving some of the heaters 13 at predetermined positions for a predetermined period of time. The heaters 13 and the driving circuit are formed by deposition on a surface of the Si substrate 11. The recording element substrates 10 each have terminals 14 to be electrically connected to the electric wiring member 30 at the ends thereof in the longitudinal direction respectively. The Si substrate 11 further has a resin-based discharge-port forming member 15 located on the surface. The Si substrate 11 further has a plurality of discharge ports 16 and an ink reservoir 17 in communication with the discharge ports 16. The discharge ports 16 and the ink reservoir 17 are formed by photolithography. The discharge ports 16 discharge ink when applied with discharge energy from the corresponding heaters 13.

FIG. 4 illustrates in detail a circuit configuration of a recording element substrate 10. The recording element substrates 10 includes switching elements 503 driving the heaters 13, a shift register (S/R) 506 of M bits for temporarily storing recording data, a latch circuit 505 for collectively holding the recording data stored in the shift register (S/R) 506, a decoder 504 (block selection circuit) selecting one or more blocks from N blocks composed of the heaters 13 and the switching elements 503. The recording element substrates 10 further includes a heater selection circuit 515 (hereinafter, collectively referred to as logic circuit), and a voltage conversion circuit 507 for converting a voltage of an output signal from the heater selection circuit 515 into a voltage driving the switching elements 503. In the structure, N heaters 13, N switching elements 503, and N heater selection circuits 515 belong to one group, and there are groups 1 to M. The recording apparatus main unit supplies clock (CLK) to a terminal 509. In synchronization with the clock, recording data (DATA) of M bits serially transferred is input via a terminal 510 and is serially stored in the shift register 506. The recording data of M bits are held in the latch circuit 505 according to latch signal (LT) input through a latch terminal 508. The recording data is transferred to the decoder 504 together with signals serially transferred from the latch circuit 505. The decoder 504 converts the data and signals into N block selection signals 518, which are input to groups 1 to M. Thereafter, M recording data signals 517 from the heating circuit 516 and the N block selection signals 518 from the decoder 504 are ORed in a matrix by the heater selection circuit 515, so that M×N heaters 13 are uniquely selected as desired. The selected heaters 13 receive a current flow from the heating circuit 516 for a predetermined period of time according to recording data signals 517 that are obtained by AND operation of the heat enable signals (HE) from a heat enable (HE) terminal 511 and signals from the latch circuit 505, resulting in driving of the heaters 13. The term "logic signal" hereinafter refers to a combination of clock (CLK), recording data (DATA), latch signal (LT), and heat enable signal (HE).

In FIG. 4, the Si substrate 11 further has: a recording element driving power (VH) terminal 530 supplying a voltage (about 24 to 30 V) that is applied to the heaters 13 as recording elements; VH power wiring 540 connecting the VH terminal 530 to the heaters 13; and a recording element GND (GNDH) terminal 531 and GNDH wiring 541 collecting the current from the heaters 13. The Si substrate 11 further has: a driving voltage generation circuit (VHT buffer) 513 as power source of the voltage conversion circuit 507; a driver driving power source (VHT) terminal 532 supplying a voltage (about 12 to 14 V) to the driving voltage generation circuit (VHT buffer) 513; a logic circuit driving power source (VDD) terminal 533 supplying a voltage (about 3 to 5 V) to activate logic circuits; and a logic GND (VSS) terminal 534 associated with the logic circuit driving power source (VDD) terminal 533.

In other words, the recording element driving power (VH) terminal 530 is a power source terminal for driving. The VH power wiring 540 is a power source line for driving. The recording element GND (GNDH) terminal 531 is a ground terminal for driving. The GNDH wiring 541 is a ground line for driving. The logic circuit driving power source (VDD) terminal 533 is a power source terminal for logic. The logic GND (VSS) terminal 534 is a ground terminal for logic.

Each of the recording element substrates 10 is provided with 30 to 60 terminals 14 (15 to 30 terminals on each side), including 6 to 20 terminals for logic signals.

Referring to FIGS. 1 and 2 again, the supporting member 20 supports and fixes the recording element substrates 10, and is made of alumina ($Al_2O_3$) and has a thickness of 0.5 to 10 mm. The supporting member 20 may be made of other materials such as those having a similar coefficient of line expansion to that of the recording element substrates 10 and having a high rigidity. Examples of these materials include silicon (Si), aluminum nitride (AlN), zirconia, silicon nitride ($Si_3N_4$), silicon carbide (SiC), molybdenum (Mo), and tungsten (W).

The supporting member 20 has ink supply ports 21 formed at positions corresponding to the ink supply ports 12 of the recording element substrates 10. The recording element substrates 10 are attached to the supporting member 20 at a precise position with a first adhesive.

The electric wiring member 30 serves to input and supply electric signals and power source voltages to the recording element substrates 10 to discharge ink. The electric wiring member 30 has one or a plurality of wiring layers therein. For example, the electric wiring member 30 may be a two-layered flexible wiring board that is made of a base material having a wiring layer on each side thereof, the upper layer being covered with a protective film.

The electric wiring member 30 has, as illustrated in FIG. 2, openings 31 where the recording element substrates 10 are assembled. The electric wiring member 30 further has terminals (second terminals) 32 electrically connected to the corresponding terminals 14 of the recording element substrates 10, and external connection terminals (first terminals) 33 electrically connected to the recording apparatus main unit.

The electric wiring member 30 has 160 to 480 terminals 32 including 40 to 160 logic signal terminals for input/output of logic signals. The common wiring patterns are integrated inside of the electric wiring member 30. The number of the external connection terminal 33 ranges from 100 to 200.

The electric wiring member 30 is adhesively attached with a second adhesive to the face where the recording element substrates 10 of the supporting member 20 is attached. There are gaps between the openings 31 and the recording element substrates 10, which are sealed by a first sealing compound. The terminals 32 of the electric wiring member 30 are electrically connected to the terminals 14 of the recording element substrates 10 by wire bonding using metal wires. The connections between the terminals 32 and 14 are sealed by a sealing compound 70. The electric wiring member 30 is bent following the shape of two sides of the supporting member 20, and secured to the sides for easy electrical connection with the recording apparatus main unit.

The ink supply member 40 supplies ink from an ink tank to the recording element substrates 10, and is made by injection molding using a resin material for example. The ink supply member 40 includes an ink reservoir 41 for supplying ink to the plurality of recording element substrates 10. The ink reservoir 41 has an opening 42 connected to the ink tank through an ink supply tube so that ink flows into the ink reservoir 41. The ink supply member 40 is secured to the supporting member 20.

A wiring layout of the electric wiring member 30 that is a feature of the present invention is described using a first exemplary embodiment.

The wiring layout of the electric wiring member 30 according to the first exemplary embodiment is described with reference to FIGS. 5 to 9. FIGS. 5 to 8 are perspective diagrams illustrating the electric wiring member 30 as seen from the front side of the electric wiring member 30.

Figure 5:
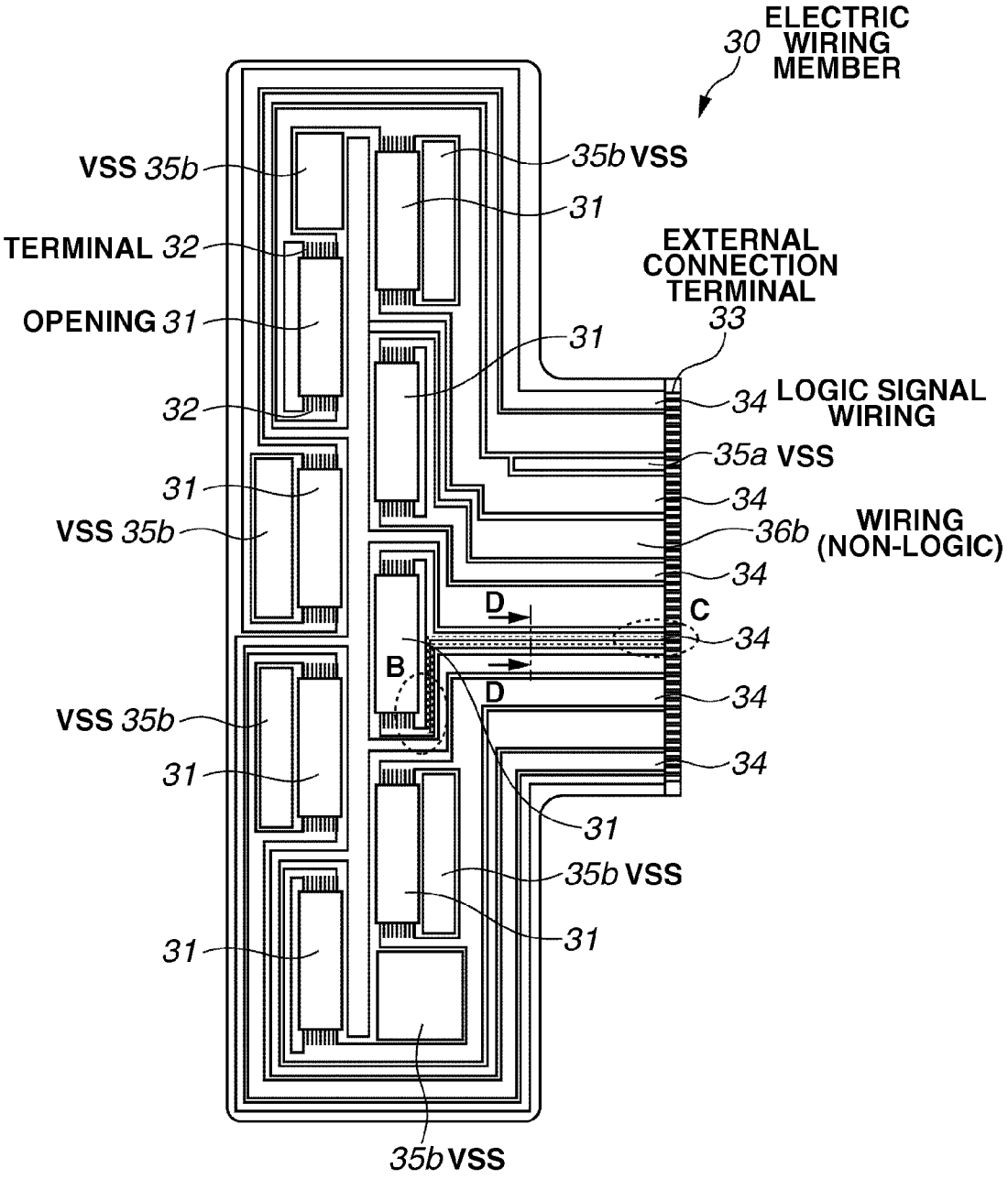
FIG. 5 schematically illustrates an example of inside wiring layout of an upper layer of an electric wiring member according to a first exemplary embodiment of the present invention.
Figure 6:
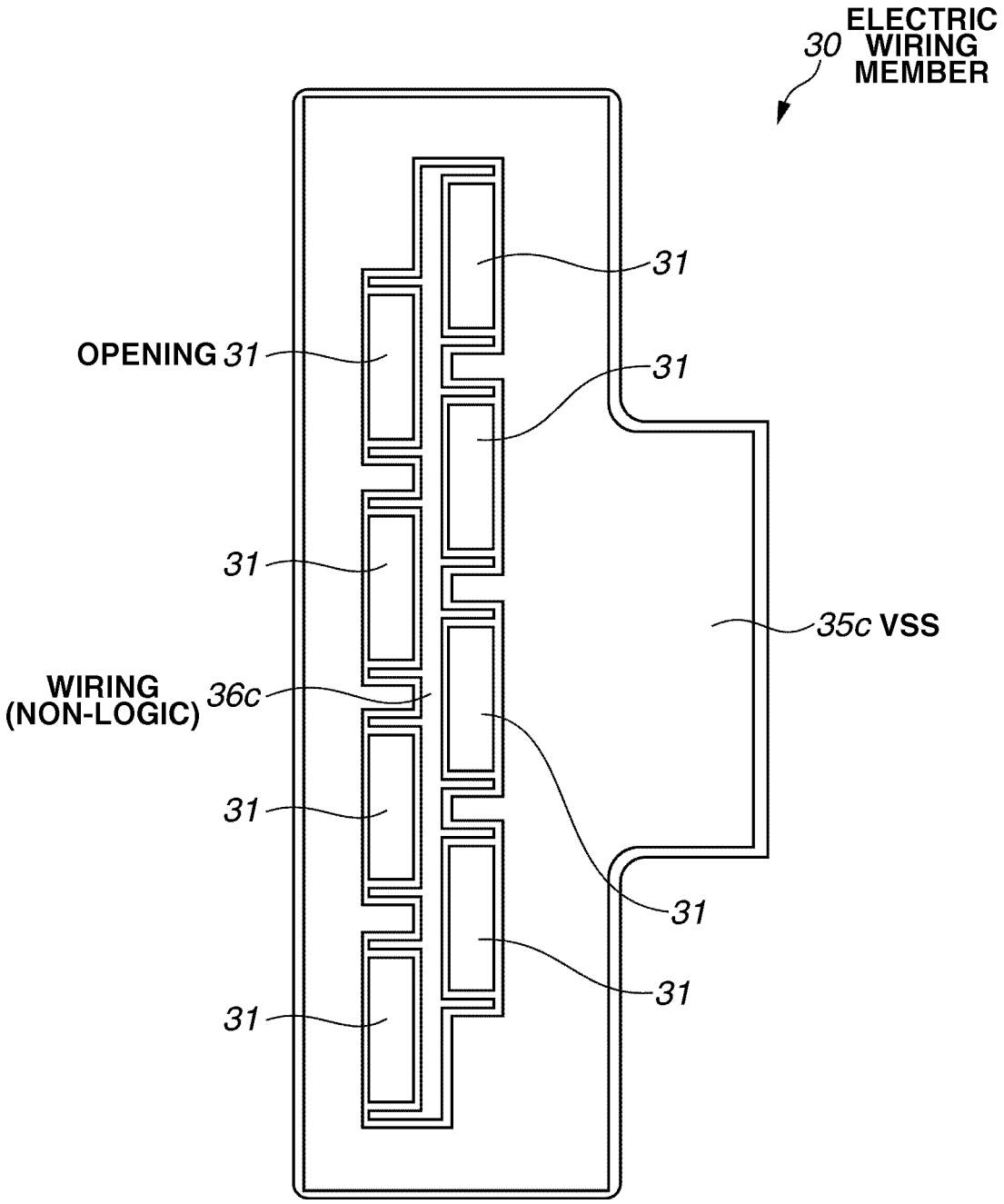
FIG. 6 schematically illustrates an example of inside wiring layout of a lower layer of an electric wiring member according to the first exemplary embodiment of the present invention.

The electric wiring member 30 has wiring layers on both sides of its base material as upper and lower layers. FIG. 5 is a schematic diagram illustrating a wiring layout of the upper layer. FIG. 6 is a schematic diagram illustrating a wiring layout of the lower layer. In FIGS. 5 and 6, the group of logic signal wiring 34 is connected to the terminals 32 and the external connection terminals 33 individually. The groups 35*a* and 35*b* of logic ground wiring (VSS line) from a logic power source are connected to one other through vias. In other words, the groups 35*a* and 35*b* are composed of ground wiring for logic. The groups 35*b* are connected to the terminals 32, and the group 35*a* is connected to the external connection terminals 33. The groups 36*b* and 36*c* are composed of wiring for transferring non-logic signals that are different from the logic signals, the wiring including, for example, those of recording element power source, recording element power source ground driver driving power source, and logic circuit driving power source. The wiring for transferring non-logic signals are connected to the terminals 32 and the external connection terminals 33.

Figure 7:
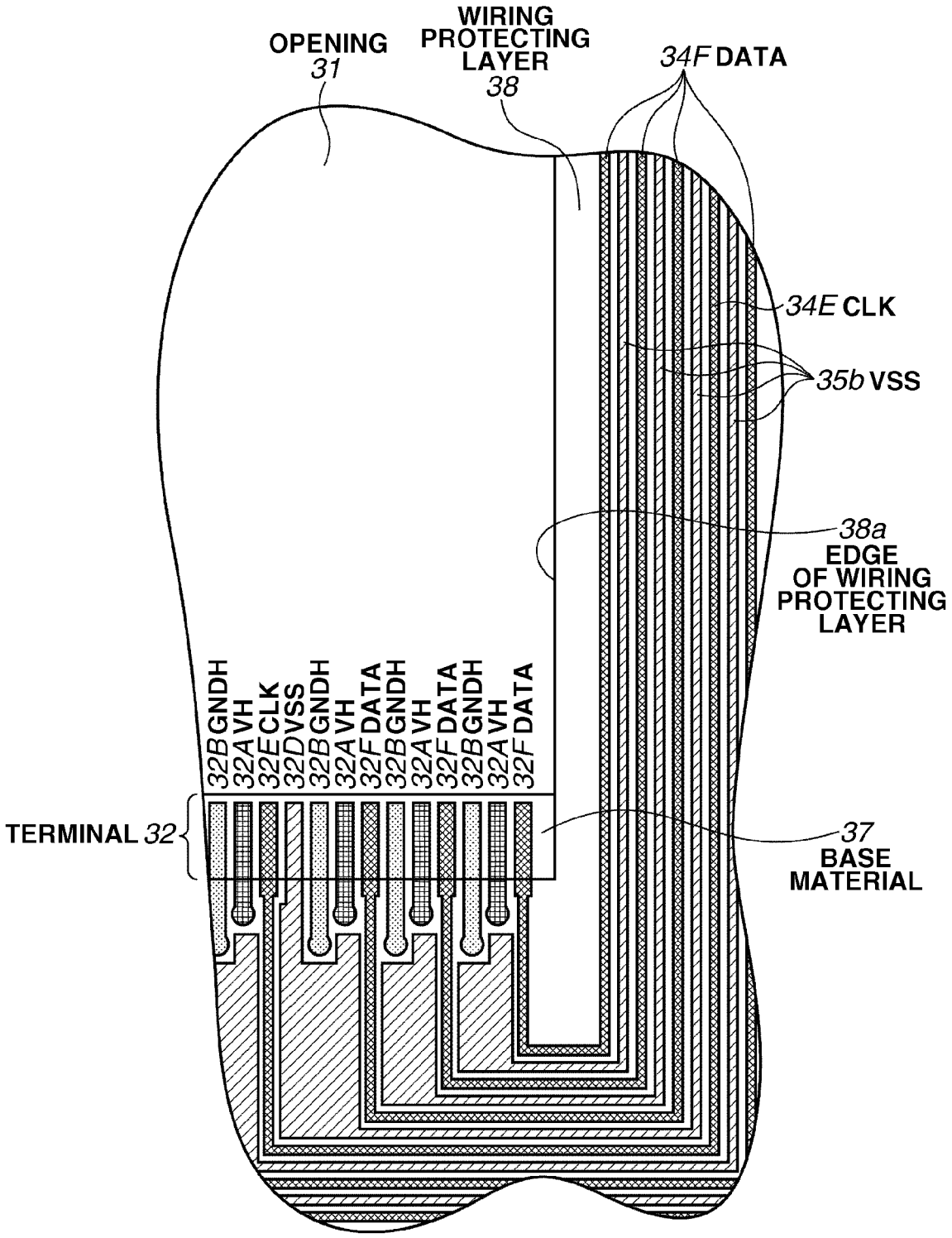
FIG. 7 is an enlarged schematic diagram illustrating part of the portion B in FIG. 5.
Figure 8:
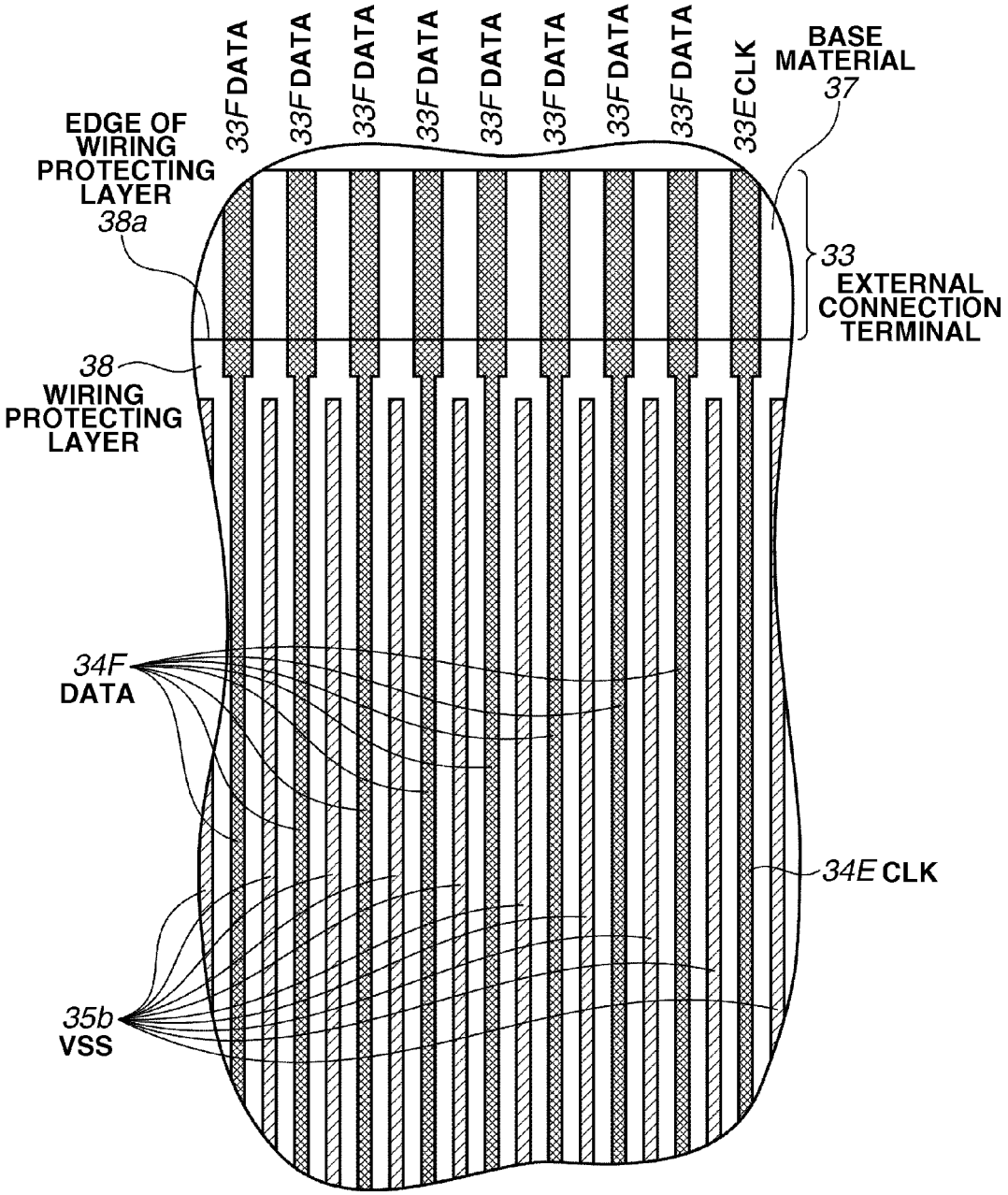
FIG. 8 is an enlarged schematic diagram illustrating part of the portion C in FIG. 5.

FIG. 7 is an enlarged diagram of the portion B in FIG. 5, illustrating in detail the wiring layout near the terminals 32. FIG. 8 is an enlarged diagram of the portion C in FIG. 5, illustrating the wiring layout near the external connection terminals 33. In FIGS. 7 and 8, the electric wiring member 30 has a base material 37, and a wiring protecting layer 38 having an edge 38*a*. The terminals 32 and the external connection terminals 33 receive the signals as illustrated in FIGS. 7 and 8, and are all exposed to the air. The terminals 32A and the terminals 32B are connected to the external connection terminals 33 using the driving signal lines 36*b* (FIG. 5) and 36*c* (FIG. 6) respectively.

CLK lines (clock wiring) 34E for CLK transfer and DATA lines (recording data wiring) 34F for DATA transfer are for operations at relatively high frequency of several MHz. In the present exemplary embodiment, as illustrated in FIGS. 7 and 8, the CLK lines 34E and the DATA lines 34F are arranged parallel to one another and to VSS lines 35*b* in the wiring areas close to the terminals 32 and the external connection terminal 33. The CLK lines 34E and the DATA lines 34F have a wiring width of 25 to 100 μm, and the VSS lines have a minimum wiring width of 25 to 100 μm, the lines being separated from one another by a gap of 25 to 50 μm. More specifically, in FIGS. 7 and 8, the VSS lines 35*b* are connected to the adjacent VSS lines 35*b* through bias across the DATA lines 34F. Accordingly, line ground patterns are arranged between the DATA lines 34F.

As described above, the high-frequency CLK lines and the high-frequency DATA lines as the first logic signal wiring are not adjacent to one another, but arranged with the VSS lines interposed therebetween in the electric wiring member 30 from the external connection terminals 33 up to the terminals 32. This structure prevents capacitive coupling between logic signal wiring, and noise generation.

Out of the VSS lines 35*b*, only one (for example) VSS line is connected to the terminals 32 and the external connection terminals 33. The other VSS lines are not connected to the terminals 32 and the external connection terminals 33, and terminate at positions near these terminals 32 and 33. This structure avoids increase in the number of the VSS terminals at the terminals 32 and the terminals 14 on the recording element substrates 10 corresponding to the terminals 32, preventing increase in size of the recording head, and suppressing noise generation.

Figure 9:
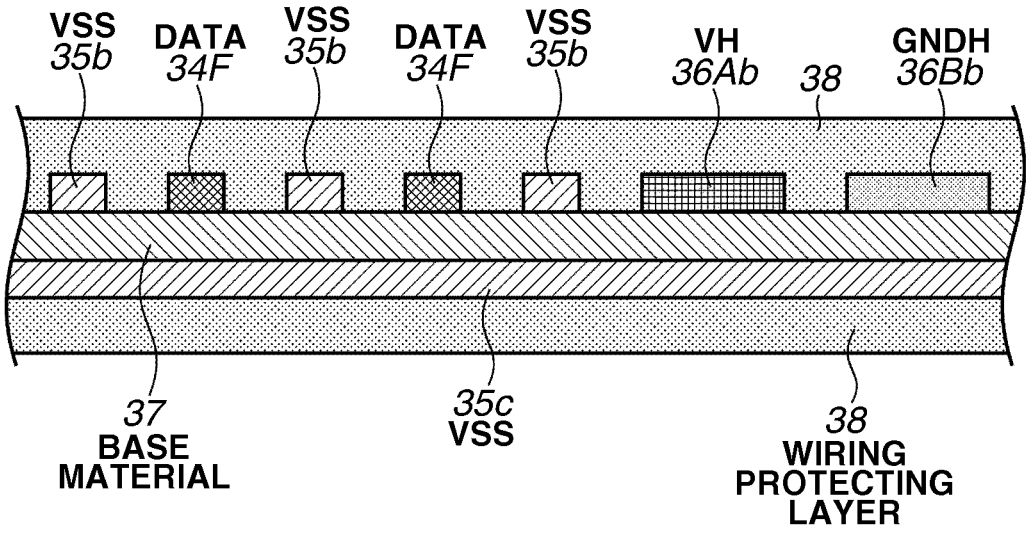
FIG. 9 schematically illustrates part of the cross section taken along the D-D wiring in FIG. 5.

As illustrated in FIG. 9, the lower layer of the logic signal wiring layers includes a solid area VSS 35*c* having the VSS lines 35*b* arranged thereacross. In this structure, the VSS lines 35*b* are connected to the area VSS 35*c* through vias. The VSS lines 35*b* may be connected to the VSS lines 35*b* through bias.

Figure 10:
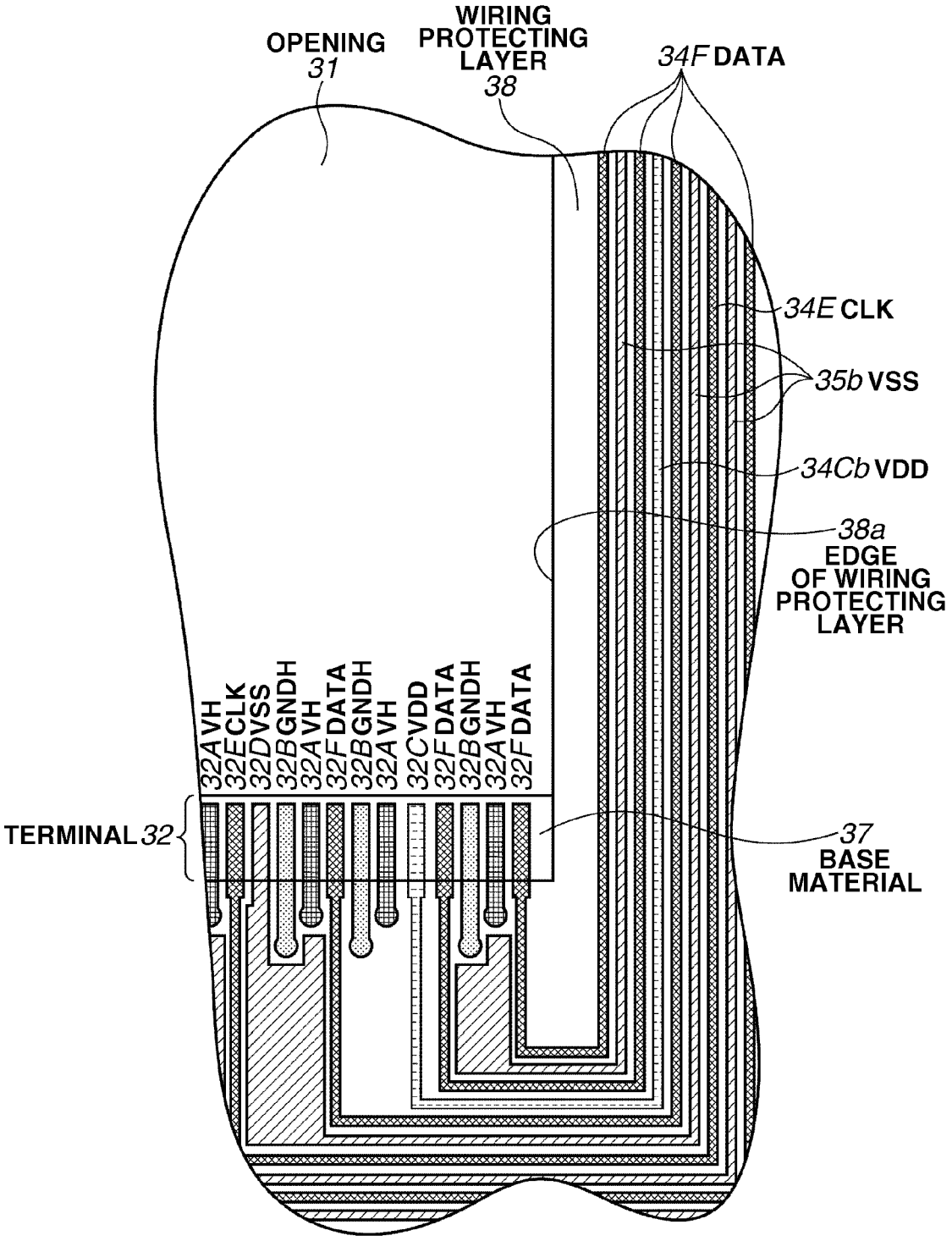
FIG. 10 is an enlarged schematic diagram illustrating another example of inside wiring layout of an upper layer of an electric wiring member according to the first exemplary embodiment of the present invention.

In the first exemplary embodiment, the VSS lines 35*b* are arranged along the CLK lines 34E and the DATA lines 34F. The present invention is, however, not limited to the structure, and as illustrated in FIG. 10, logic power source lines (VDD wiring) 36Cb may be arranged along the CLK lines 34E and the DATA lines 34F. The VDD wiring 36Cb supplies a constant power source voltage VDD to logic circuits and has a relatively low current density. The latter case is also unlikely to generate noise that affects the CLK lines 34E and the DATA lines 34F.

Alternatively, the CLK lines 34E and the DATA lines 34F may be arranged adjacent to LT lines (latch signal wiring) and HE lines (heat enable signal wiring) as second logic signal wiring. The LE lines and the HE lines transfer signals LT (latch signals for temporarily storing recording data) and signals HE (heat enable signals determining the period of time to drive the recording elements), which are second logic signals having lower frequency components than those of DATA. This case is also unlikely to generate noise that affects the CLK lines 34E and the DATA lines 34F.

In the first exemplary embodiment, the VSS lines 35*b* is arranged adjacent to only the DATA lines 34F out of the logic signal wiring. The present invention is, however, not limited to the structure, and the VSS lines 35*b* may be arranged adjacent to logic signal wiring that transfers logic signals having frequency components equal to or half that of the clock. Alternatively, the VSS lines 35*b* may be arranged adjacent to all of the logic signal lines. The latter case particularly avoids effect of noise, providing a more reliable recording head.

When the electric wiring member 30 is provided with wiring to be protected from noise, other than the logic signal wiring, such as wiring sensing temperature of the recording element substrates 10, the wiring can be arranged adjacent to the VSS lines as described above. This structure enables precise detection of temperature without effect of noise.

Figure 11:
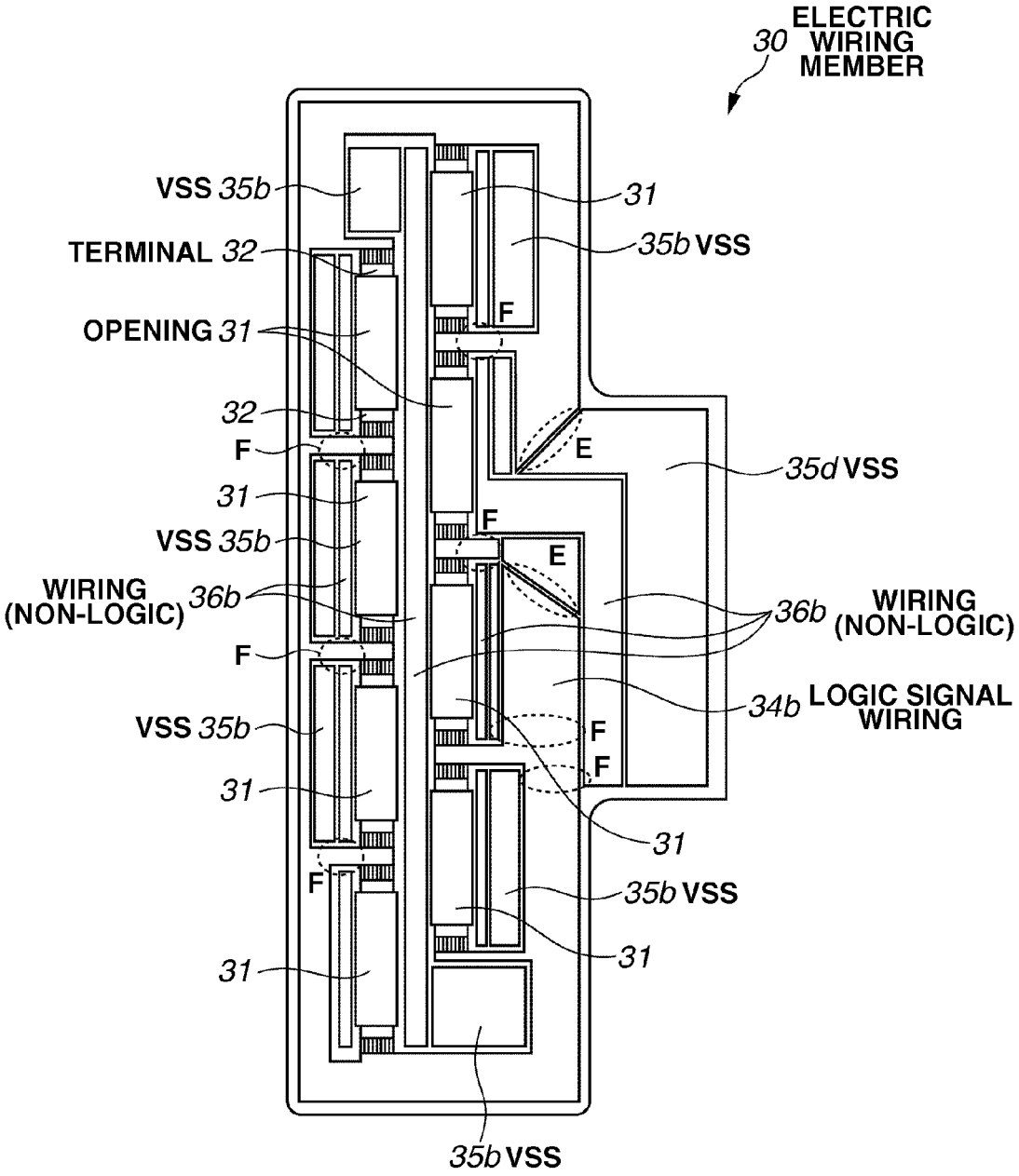
FIG. 11 is an enlarged schematic diagram illustrating another example of inside wiring layout of an upper layer of an electric wiring member according to the first exemplary embodiment of the present invention.
Figure 12:
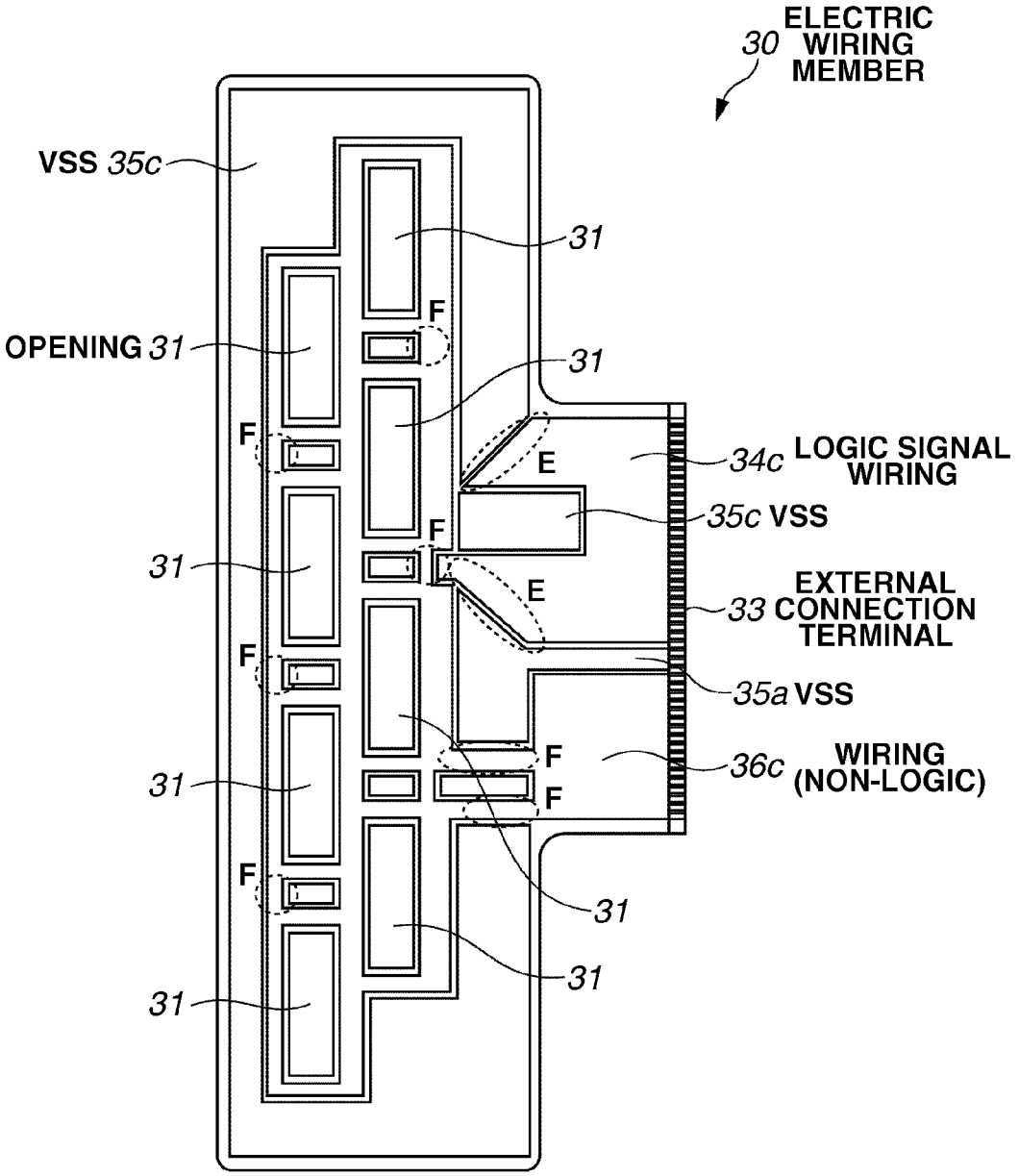
FIG. 12 is an enlarged schematic diagram illustrating another example of inside wiring layout of a lower layer of an electric wiring member according to the first exemplary embodiment of the present invention.

FIGS. 11 and 12 each illustrate another wiring layout of the electric wiring member 30 according to the first exemplary embodiment. FIG. 12 is a perspective diagram. In the present wiring layout, the external connection terminals 33 are disposed on the lower layer due to a connection style of the recording head, and the logic signal wiring and wiring for power source system are all connected to the external connection terminals 33 on the lower layer to facilitate routing of wiring at the recording apparatus main unit. In FIGS. 11 and 12, the electric wiring member 30 has logic signal wiring 34, as in the above wiring layout, and wiring for power source system 36*b* and 36*c*. Between the wiring groups, the VSS lines 35*a* to be connected to the external connection terminals 33 are interposed.

The logic signal lines 34*b* on the upper layer are connected to the logic signal lines 34*c* on the lower layer through vias at the E portion, and as in FIGS. 7 to 9, the CLK lines and the DATA lines are arranged adjacent to the VSS lines. The VSS lines 35*c* on the lower layer are connected to the VSS lines 35*d* on the upper layer through vias, and the VSS lines 35*d* are connected through vias to the VSS lines 35*a* on the lower layer to be connected to the external connection terminals 33, resulting in throughout connection of the VSS lines 35.

Figure 13:
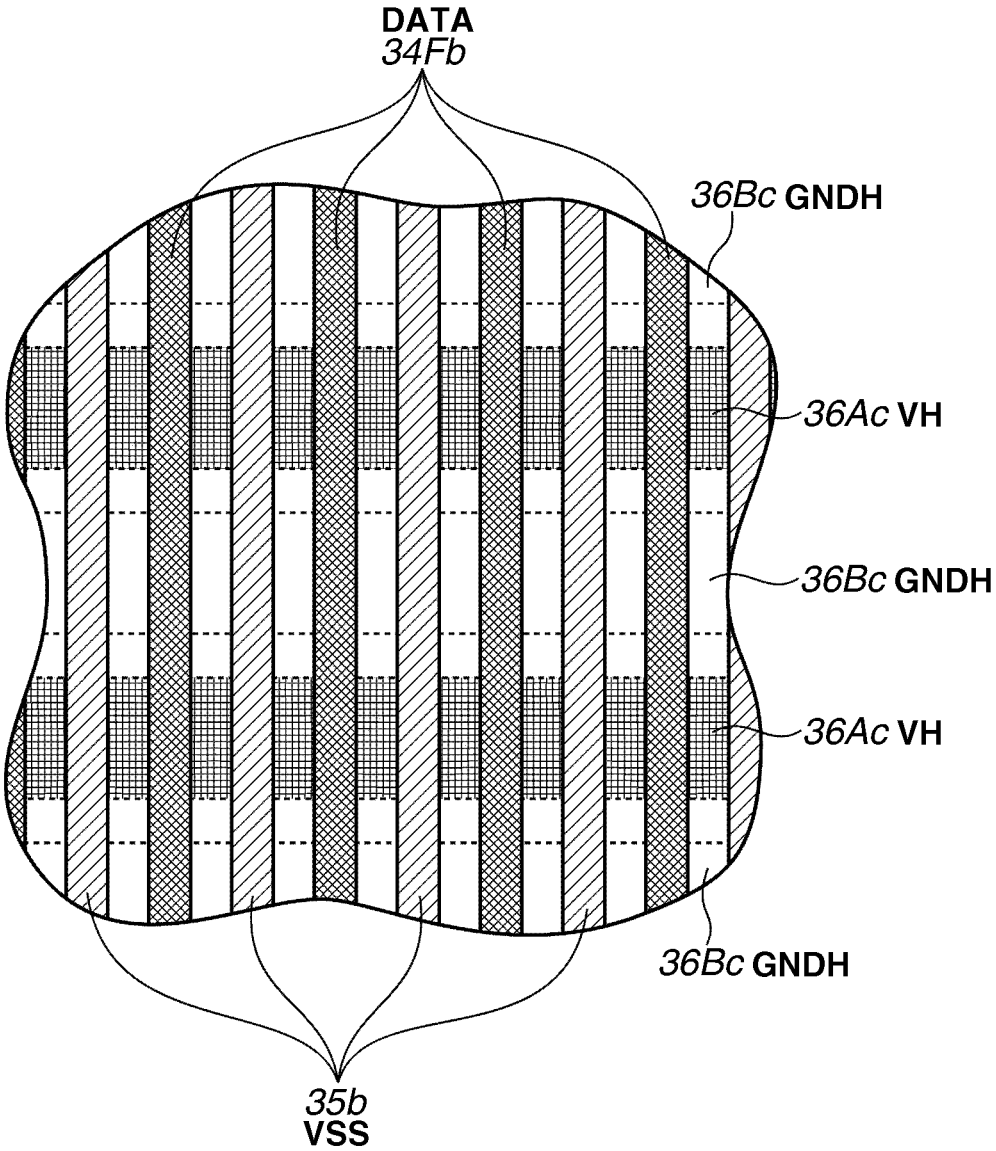
FIG. 13 schematically illustrates inside wiring layout of wiring arranged in the portion F in FIG. 11 through upper and lower layers of an electric wiring member.

In the wiring layout, the position of logic signal wiring approximately corresponds to the positions of VSS lines 35 through the adjacent wiring layers in the stack direction of the layers, but wiring for power source system is provided at a part (the F portion in FIGS. 11 and 12) of the layout. However, such a part is minimized in the above wiring layout. In addition, in this part of the layout, as illustrated in FIG. 13, the logic signal lines 34*b* are arranged perpendicular to wiring of power source system 36A and 36B, and have a magnetic field in a direction different from that of the wiring of power source system 36A and 36B, which prevents induction of noise. Consequently, the present wiring layout also suppresses malfunction of logic circuits due to noise, and provides a highly reliable recording head.

In this wiring layout also, the VSS lines can be arranged to be adjacent to logic signal wiring of low frequency and other wiring that needs to be kept away from noise.

Figure 14:
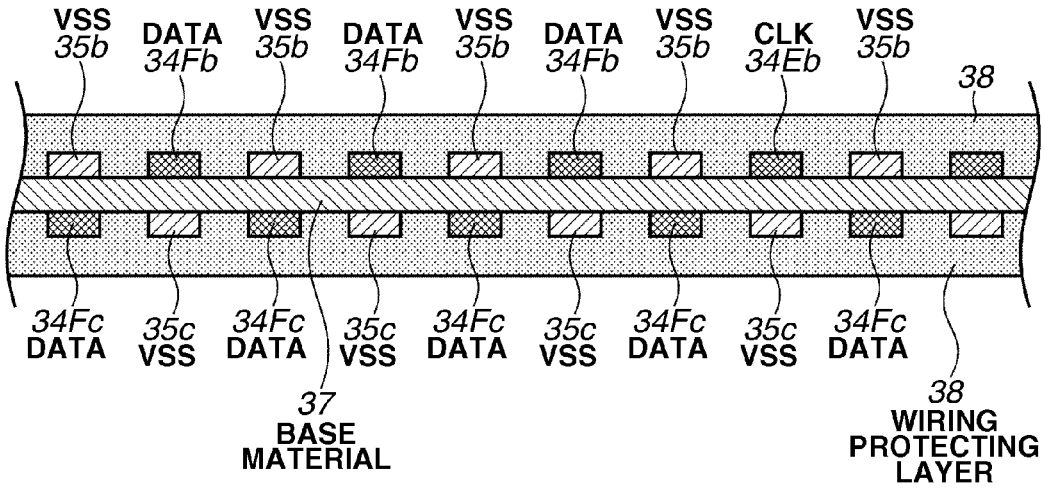
FIG. 14 is a schematic cross sectional diagram illustrating a wiring layout of an electric wiring member according to a second exemplary embodiment of the present invention.

FIG. 14 illustrates a modified example of a wiring layout of the electric wiring member 30 according to the first exemplary embodiment. The modified example includes logic signal wiring on both of the upper and lower layers due to further increase in the number of the recording element substrates and downsizing of the recording head.

In the wiring layout illustrated in FIG. 14, the CLK lines 34E and the DATA lines 34F are adjacent to the VSS lines 35*b* on one wiring layer, and also adjacent to the VSS lines 35*b* formed on the other wiring layer in the stacking direction of the layers. This structure prevents induction of noise even when the CLK lines 34E and the DATA lines 34F are routed through a plurality of layers.

Figure 15:
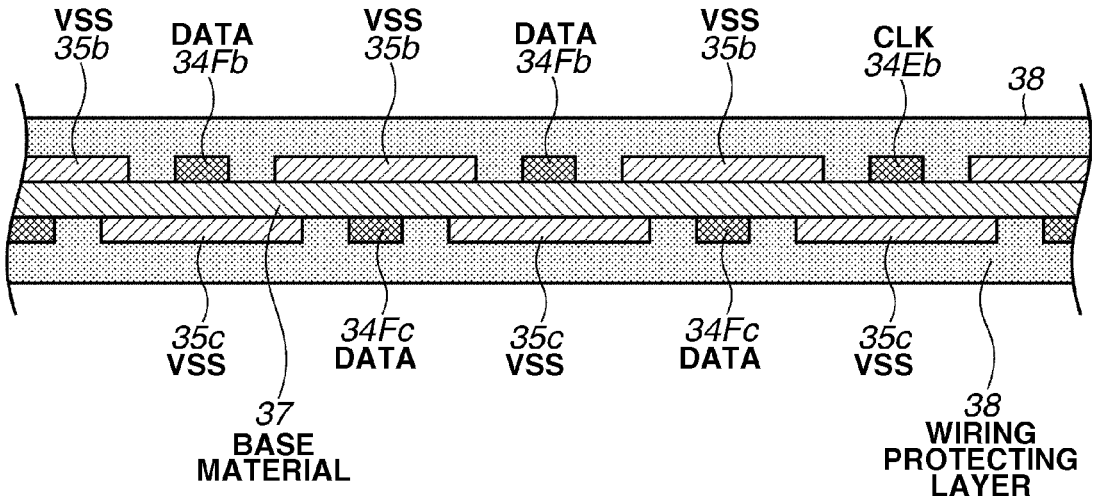
FIG. 15 is a schematic cross sectional diagram illustrating another wiring layout of an electric wiring member according to the second exemplary embodiment of the present invention.
Figure 16:
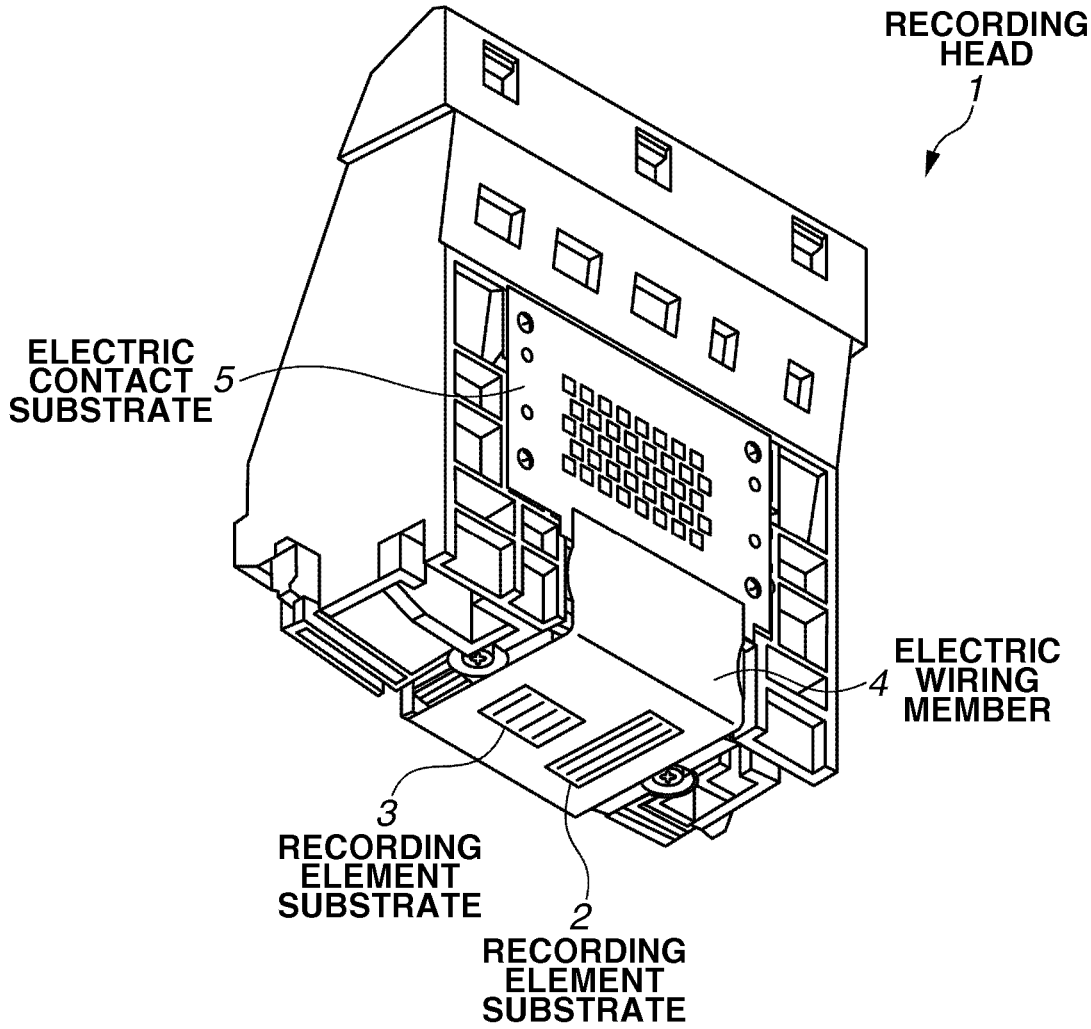
FIG. 16 illustrates a problem of a conventional inkjet recording head.

In the wiring layout illustrated in FIG. 15, the VSS lines 35*b* have a wiring width larger than those of the CLK lines 34E and the DATA lines 34F. This wiring structure weakens capacitive coupling between logic signal wiring through wiring layers, which further prevents induction of noise.

In the modified example also, CLK lines 34E and the DATA lines 34F can be arranged adjacent to the VDD wiring and logic signal wiring of low frequency. Alternatively, the VSS lines can be adjacent to other logic signal wiring.

As a modified example of the first exemplary embodiment, the electric wiring member 30 may have wiring on a single layer. In this case, the VSS lines 35*b* are connected to one another through vias. The logic signal wiring may be a differential system.

In the exemplary embodiment, the electric wiring member has the two-layered structure, but can be adapted to a three- or more layered structure. Alternatively, the electric wiring member may have a single layer structure.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-108406 filed May 10, 2010, which is hereby incorporated by reference herein in its entirety.

What is claimed is:

1. A recording head, comprising:

a plurality of recording element substrates having a recording element and a logic circuit cofigured to control driving of the recording element; and an electric wiring member cofigured to provide a wiring layer that has a plurality of first groups of a plurality of terminals for connecting to the plurality of recording element substrates, a second group of a plurality of terminals for connecting to a recording apparatus, and a plurality of signal lines configured to connect the plurality of first groups of terminals to the second group of terminals, wherein the plurality of signal lines include a plurality of clock lines for transmitting a clock signal to the recording element, a plurality of data lines for transmitting data to the recording element, and a ground line configured to connect the first group of terminals and the second group of terminals, wherein the ground line has a plurality of branched lines branched off from the ground line, one end side of the plurality of branched lines extends to a vicinity of the second group of terminals without being connected to the second group of terminals, wherein the clock lines are not directly adjacent to the data lines, and wherein one of the branched lines is disposed between a clock line of the clock lines and a data line of the data lines.

2. The recording head according to claim 1, wherein the terminals of the first group are arranged adjacent to one another, and are connected at least to a driving power source line, and a driving ground line.

3. The recording head according to claim 1, wherein a predetermined signal includes a signal that determines a period of time to drive the recording element.

4. The recording head according to claim 1, wherein the logic circuit includes a storing circuit configured to store a value of a data signal, and wherein a predetermined signal includes a latch signal that controls the storing circuit.

5. The recording head according to claim 1, wherein the electric wiring member is provided with a first wiring layer and a second wiring layer, the first group of terminals, the second group of terminals and the plurality of signal lines are formed on the first wiring layer, and a solid area of a second ground line is formed on the second wiring layer.

6. The recording head according to claim 1, wherein a width of the one end side of a branched line of the plurality of branched lines is smaller than a width of a terminal of the second group of terminals.

7. The recording head according to claim 1, wherein the one end side of the plurality of branched lines is located outside a region where the second group of terminals are arranged.

* * * * *